US010384903B2

(12) United States Patent
Rasmussen et al.

(10) Patent No.: US 10,384,903 B2
(45) Date of Patent: Aug. 20, 2019

(54) PARTIALLY DRIED INKJET MEDIA FINISHER

(71) Applicant: Hewlett-Packard Development Company, L.P., Houston, TX (US)

(72) Inventors: Steve O Rasmussen, Vancouver, WA (US); Al Olson, Vancouver, WA (US); Bruce G Johnson, LaCenter, WA (US); Elliott Downing, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/759,927

(22) PCT Filed: Dec. 9, 2015

(86) PCT No.: PCT/US2015/064681
§ 371 (c)(1),
(2) Date: Mar. 14, 2018

(87) PCT Pub. No.: WO2017/099747
PCT Pub. Date: Jun. 15, 2017

(65) Prior Publication Data

US 2018/0257897 A1 Sep. 13, 2018

(51) Int. Cl.
*B41J 11/00* (2006.01)
*B41J 13/00* (2006.01)
(Continued)

(52) U.S. Cl.
CPC ..... *B65H 31/32* (2013.01); *B41J 11/0015* (2013.01); *B41J 13/00* (2013.01); *B41J 13/08* (2013.01); *B41J 13/106* (2013.01); *B41J 29/38* (2013.01); *B65H 29/18* (2013.01); *B65H 31/34* (2013.01); *B65H 35/00* (2013.01); *B65H 37/04* (2013.01); *B65H 2301/5126* (2013.01);
(Continued)

(58) Field of Classification Search
CPC ..... B65H 31/32; B65H 35/00; B65H 37/04; B41J 11/0015; B41J 15/005; B41J 11/66
USPC ..... 347/101, 102, 104
See application file for complete search history.

(56) References Cited

U.S. PATENT DOCUMENTS 5,098,074 A 3/1992 Mandel et al.
5,229,812 A 7/1993 Toyama et al.
(Continued)

FOREIGN PATENT DOCUMENTS

EP 0557827 8/1999
EP 2085240 8/2009

OTHER PUBLICATIONS

Hewlett-Packad Company. HP LaserJet Multifunction Finisher. http://www.lbrty.com/tech/Manuals_HP/ ~2004 ~297 pages.

*Primary Examiner* — An H Do
(74) *Attorney, Agent, or Firm* — Brooks Cameron & Huebsch, PLLC

(57) ABSTRACT

In one implementation, a system for a partially dried inkjet media finisher includes a media input zone to receive printed media, wherein the printed media is partially dried inkjet media, a transport zone to receive the printed media from the media input zone to lower the print media to an accumulation zone that is coupled vertically below the transport zone, wherein the accumulation zone organizes the received printed media, and the accumulation zone to lower the printed media to an output zone coupled vertically below the accumulation zone, wherein the output zone receives a completed print job from the accumulation zone.

15 Claims, 3 Drawing Sheets

(51) Int. Cl.

| | |
|---|---|
| ***B65H 31/32*** | (2006.01) |
| ***B41J 13/08*** | (2006.01) |
| ***B41J 13/10*** | (2006.01) |
| ***B41J 29/38*** | (2006.01) |
| ***B65H 29/18*** | (2006.01) |
| ***B65H 31/34*** | (2006.01) |
| ***B65H 35/00*** | (2006.01) |
| ***B65H 37/04*** | (2006.01) |

(52) U.S. Cl.

CPC ..... *B65H 2301/5152* (2013.01); *B65H 2408/1222* (2013.01); *B65H 2801/15* (2013.01); *B65H 2801/27* (2013.01)

(56) References Cited

U.S. PATENT DOCUMENTS

| | | | |
|---|---|---|---|
| 5,435,544 | A | 7/1995 | Mandel |
| 6,268,909 | B1 | 7/2001 | Honmochi et al. |
| 6,379,063 | B1 | 4/2002 | Gutierrez et al. |
| 6,478,490 | B2 | 11/2002 | Kelley et al. |
| 6,779,790 | B2 | 8/2004 | Kitahara |
| 7,543,806 | B2 | 6/2009 | Nakamura et al. |
| 7,866,648 | B2 | 1/2011 | Noh |
| 8,439,583 | B2 | 5/2013 | Kersey et al. |
| 8,496,239 | B2 | 7/2013 | Furuhashi et al. |
| 2006/0176336 | A1 | 8/2006 | Moore et al. |

PARTIALLY DRIED INKJET MEDIA FINISHER

BACKGROUND

Inkjet printers can deposit quantities of printing fluid onto a printable media (e.g., paper, plastic, etc.). In some examples, inkjet printers can create a curl and/or cockle in the printed media when the printing fluid droplets deposited by the inkjet printer are not completely dry. In some examples, a number of physical properties of the printable media can be changed when the printing fluid droplets deposited by the inkjet printer are not completely dry. For example, the stiffness of the printable media can be changed when the printing fluid droplets deposited by the inkjet printer are not completely dry. The curl, cockle, and/or other physical properties that change due to the printing fluid droplets can make finishing processes difficult.

DETAILED DESCRIPTION

Figure 1:
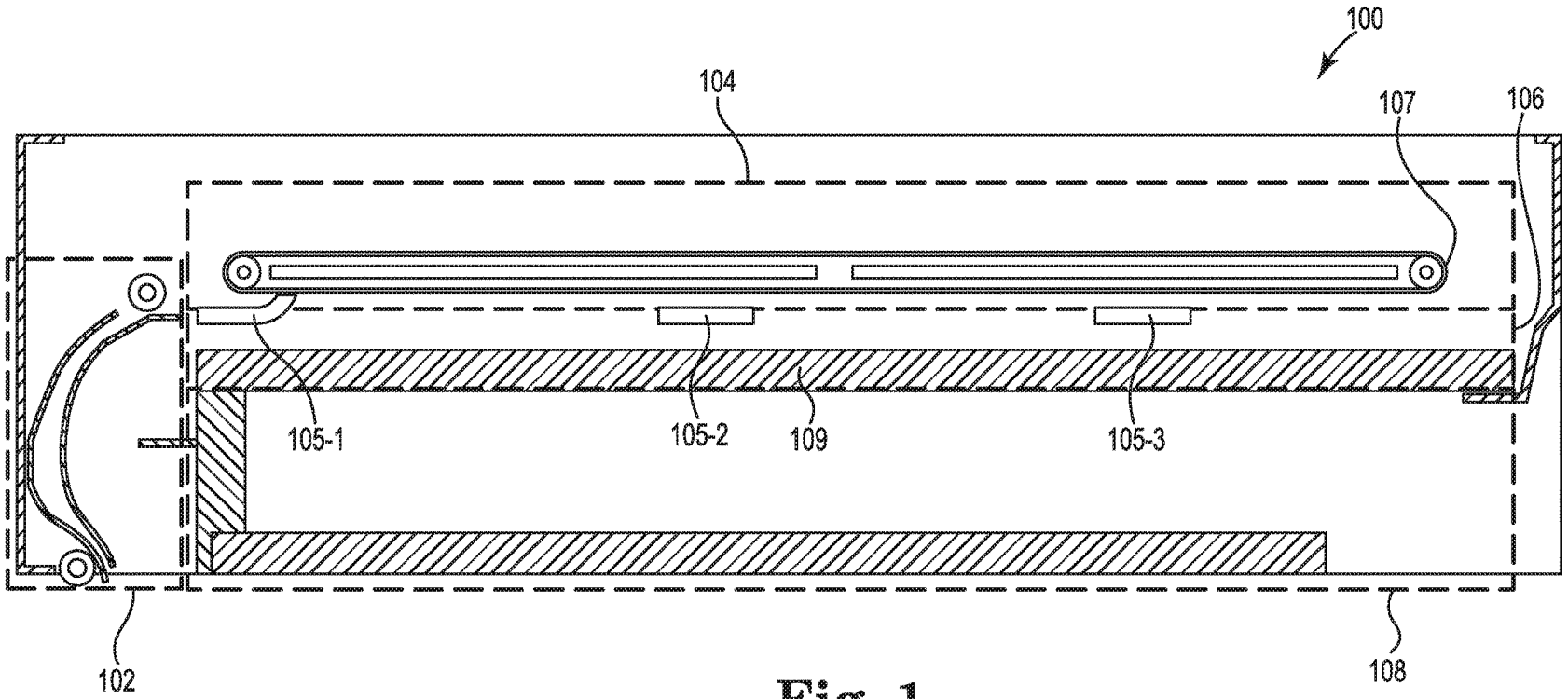
FIG. 1 illustrates an example system for a partially dried inkjet media finisher consistent with the present disclosure.

A number of systems and devices for a partially dried inkjet media finisher are described herein. In some examples, a system for a partially dried inkjet media finisher can include a media input zone to receive printed media, wherein the printed media is partially dried inkjet media, a transport zone to receive the printed media from the media input zone and to lower the print media to an accumulation zone that is coupled vertically below the transport zone, wherein the accumulation zone organizes the received printed media, and the accumulation zone to lower the printed media to an output zone coupled vertically below the accumulation zone, wherein the output zone receives a completed print job from the accumulation zone. The partially dried inkjet media finisher as described herein can provide stacking, aligning, and finishing processes of partially dried or wet inkjet media. As used herein, partially dried inkjet media can include media with applied printing fluid from an inkjet type printing device that is not completely dried on the media.

The partially dried inkjet media can provide difficulties when stacking, aligning, and/or finishing. For example, the partially dried inkjet media can have distorted properties such as a curl, a cockle, a reduction in stiffness, increased surface roughness, and/or increased sheet to sheet friction of the media. In some examples, these distorted properties can be caused by printing fluid deposited on the media and the media absorbing the printing fluid. For example, the printing fluid can be in a liquid state that can be absorbed by a media such as paper. In this example, the liquid state of the printing fluid can cause the distorted properties of the media in a similar way that other liquids may distort the properties of the media.

The partially dried inkjet media finisher as described herein can utilize a number of zones (e.g., media input zone, accumulation zone, an output zone, etc.) to provide stacking, aligning, holding, and finishing process of the partially dried inkjet media. In some examples, the partially dried inkjet media finisher can utilize a vertically layered system compared to previous finishing systems that utilized a horizontal transfer system (e.g., transferring media horizontally between zones, etc.). In some examples, the partially dried inkjet media finisher can separate a plurality of print jobs between an accumulation zone and an output zone to prevent media that is part of a completed job from interacting with media that is being stacked, aligned, and/or finished as described herein.

In some examples, the partially dried inkjet media finisher as described herein can be within the same footprint (e.g., base dimensions, etc.) of a host printer (e.g., printer coupled to the partially dried inkjet media finisher, etc.). The partially dried inkjet media finisher can utilize a variety of media types and a variety of media sizes. For example, the partially dried inkjet media finisher can utilize a variety of media thickness types as well as a size range from about size A3 to size A4, among other sizes.

In some examples, the partially dried inkjet media finisher can minimize disruption and/or damage to a completed print job by providing a vertical transport from the accumulation zone to the output zone of the partially dried inkjet media finisher. In some examples, the partially dried inkjet media finisher can also provide for a finishing process such as stapling. In some examples, the partially dried inkjet media finisher can provide a finishing process on multiple sides of the partially dried inkjet media.

The figures herein follow a numbering convention in which the first digit corresponds to the drawing figure number and the remaining digits identify an element or component in the drawing. Elements shown in the various figures herein may be capable of being added, exchanged, and/or eliminated so as to provide a number of additional examples of the present disclosure. In addition, the proportion and the relative scale of the elements provided in the figures are intended to illustrate the examples of the present disclosure, and should not be taken in a limiting sense.

FIG. 1 illustrates an example system 100 for a partially dried inkjet media finisher consistent with the present disclosure. The system 100 can be a side view of a partially dried inkjet media finisher as described herein. In some examples, the system 100 can be coupled to a printing device (e.g., inkjet printer, etc.). As described herein, the printing device can be an inkjet printing device that can deposit printing fluid (e.g., liquid printing fluid) on a media (e.g., paper, plastic, etc.).

As described herein, the system 100 can be within a footprint of a corresponding printing device. As used herein, the footprint of a corresponding printing device includes the base dimensions (e.g. length and width, etc.) of the corresponding printing device. In some examples, the system 100 can include a width (left to right in FIG. 1) that is relatively close in size compared to a largest supported media. In some examples, the width of a transport zone 104, an accumulation zone 106 and an output zone 108 can be the same size as the largest supported media. In these examples, the width of the media input zone 102 can be the increase in width beyond the width of the largest supported media. In some examples, the system 100 can include a number of drawers that can open to allow access to the interior of the system. The number of drawers may extend beyond the footprint in some examples, but the operational footprint of the system can still be within the footprint of the printing device.

The system 100 can include a number of zones (e.g., media input zone 102, transport zone 104, accumulation zone 106, output zone 108, etc.). In some examples, the number of zones or a portion of the number of zones can be stacked or aligned vertically compared to previous systems that utilize horizontal transition of printed media. The number of zones aligned vertically can provide for a better separation between printed media being stacked, aligned, and/or finished and printed media that is completed.

The system 100 can include a media input zone 102. The media input zone 102 can receive partially dried inkjet media from a printing device and transport the partially dried inkjet media from the printing device to a transport zone 104. In some examples, the media input zone 102 can utilize a number of rollers to transport the partially dried inkjet media from the printing device to the transport zone 104. In some examples, the system 100 can be located above a printing device. In these examples, the media input zone 102 can transport the partially dried inkjet media from a position below the transport zone 104 to the transport zone 104. In some examples, the system 100 can be located below the printing device and the media input zone 102 can transport the partially dried inkjet media from a position above the transport zone 104 to the transport zone 104.

The media input zone 102 is illustrated on a left side of the transport zone 104, however, the media input zone 102 can be located on a right side of the transport zone 104 as illustrated in FIG. 1. In some examples, the media input zone 102 can be located at a number of other positions based on a location of the printing device coupled to the system 100. That is, the media input zone 102 can be located at a position to receive the partially dried inkjet media and transport the partially dried inkjet media to the transport zone 104.

In some examples, the transport zone 104 can include a belt 107 that can receive and transport partially dried inkjet media from the media input zone 102 to a particular location of the accumulation zone 106. In some examples, the belt 107 of the transport zone 104 can be utilized to position each sheet of received partially dried inkjet media at a specific location of the accumulation zone 106 that each sheet is oriented and aligned when the sheet is received by the accumulation zone 106. For example, the transport zone 104 can utilize the belt 107 to move the partially dried inkjet media from the media input zone 102 on a side of the system to the accumulation zone 106 located below the transport zone 104.

In some examples, the media input zone 102 and the transport zone 104 can utilize cooperative speed control. As used herein, cooperative speed control includes coordinating transport speed of the partially dried inkjet media between a number of zones. For example, the media input zone 102 can include a number of pullers that are transporting the partially dried inkjet media at a speed that is coordinated with the belt 107 of the transport zone 104. In this example, the coordinated speed of the number of pullers can be a speed that is substantially similar or the same as the speed of the belt 107 to prevent buckling and/or tearing of the partially dried inkjet media. That is, the speed of a number of pullers of the media input zone 102 can match a speed of the belt 107 of the transport zone 104. In some examples, the cooperative speed control can be utilized until a sheet of partially dried inkjet media leaves the media input zone 102. That is, when the partially dried inkjet media leaves the media input zone 102 the speed of the number of pullers can be altered to a speed that is not at a coordinating transport speed with the belt 107 of the transport zone 104.

In some examples, the transport zone 104 can utilize a number of clamps 105-1, 105-2, 105-3 and/or alignment devices to deliver the partially dried inkjet media on the accumulation zone 106. In some examples, the transport zone 104 can control each of the number of clamps 105-1, 105-2, 105-3 independently to align each of a plurality of sheets of partially dried inkjet media in the accumulation zone 106. In some examples, the transport zone 104 can be advantageous over previous systems by separating the sheets of partially dried inkjet media of the accumulation zone 106 from sheets of partially dried inkjet media being transported by the transport zone 104. For example, a number of clamps 105-1, 105-2, 105-3 can be positioned between the transport zone 104 and the accumulation zone 106. In this example, the belt 107 of the transport zone 104 can transport the partially dried inkjet media above the number of clamps 105-1, 105-2, 105-3 located between the transport zone 104 and the accumulation zone 106 to a position of the accumulation zone 106. As used herein, organizing the partially dried inkjet media can include stacking, aligning, and/or finishing the partially dried inkjet media. In some examples, the accumulation zone 106 can receive a plurality of partially dried inkjet media sheets that can be aligned and clamped via a number of clamps 105-1, 105-2, 105-3.

In some examples, the transport zone 104 can be utilized to lower the partially dried inkjet media to a position on the accumulation zone 106 based on a size of the partially dried inkjet media. In some examples, the transport zone 104 can transport the partially dried inkjet media over a clamp 105-1 to a registration wall or stopping point for a first end of the partially dried inkjet media. In this example, the clamp can be positioned to put pressure on the partially dried inkjet media when it is lowered to the accumulation zone 106.

The transport zone 104 can be located above the accumulation zone 106 to prevent distorted partially dried inkjet media being transported by the belt 107 of the transport zone 104 from interacting with already positioned partially dried inkjet media located in the accumulation zone 106. For example, previous systems may utilize a horizontal transition from a first zone to a second zone, which can cause issues with distorted partially dried inkjet media.

When the partially dried inkjet media is stacked and/or aligned in the accumulation zone 106 a determination can be made whether a finishing process is to be performed on the stacked and/or aligned partially dried inkjet media. The finishing process can include, but is not limited to: a stapling process, a hole punch process, an embossing process, and/or a stitching process among other finishing processes that can be performed on a media sheet or stack of media sheets.

In some examples, the accumulation zone 106 can organize the received partially dried inkjet media. As used herein, organizing the partially dried inkjet media can include stacking, aligning, supporting, holding, and/or finishing the partially dried inkjet media. In some examples, the accumulation zone 106 can receive a plurality of partially dried inkjet media sheets that can be aligned and clamped via a number of clamps 105-1, 105-2, 105-3. In one example, the accumulation zone 106 can have a height of approximately 15 millimeters, which can allow for approximately 50 sheets of partially dried inkjet media depending on a thickness of the partially dried inkjet media sheets.

When a finishing process is to be performed on the stack of partially dried inkjet media sheets, the accumulation zone 106 can utilize an intermediate support and transport device such as a mezzanine 109 or similar device to shift the stack of partially dried inkjet media sheets to perform a finishing process. In some examples, the finishing process can include a device that is coupled to any edge of the accumulation zone 106 portion of the system 100. In some examples, the mezzanine 109 or similar device can be utilized to push a partially dried inkjet media sheet or a stack of partially dried inkjet media for a stapling process.

In some examples, the finishing process can utilize a stapler for performing a stapling finishing process. As will be described further herein with reference to FIG. 2 and FIG. 3, the stapler can run along the length of the accumulation zone 106. In some examples, the finishing process can be performed at any point along the edge of the stack of partially dried inkjet media sheets that is pushed by a mezzanine 109 or similar device. For example, a stapler can be positioned on a track that allows the stapler to move from a first end of the stack of partially dried inkjet media sheets to a second end of the stack of partially dried inkjet media sheets. The track can allow the stapler to put a single staple on a number of different corners of the stack of partially dried inkjet media sheets based on a position the stack of partially dried inkjet media sheets are placed on the accumulation zone 106. In addition, the track can allow the stapler to make a plurality of staples along an edge of the stack of partially dried inkjet media sheets.

When the finishing process is completed or when there is no finishing process to be performed, the accumulation zone 106 can lower the completed print job (e.g., stack of partially dried inkjet media sheets, single partially dried inkjet media sheet, etc.) can be lowered to an output zone 108. In some examples, the accumulation zone 106 and the output zone 108 can be separated by a barrier to prevent interaction between the stack of partially dried inkjet media sheets that are within the accumulation zone and the completed print jobs located in the output zone 108.

In some examples, the stack of partially dried inkjet media sheets can be lowered to the output zone 108 by moving the barrier to allow the completed print job to be lowered to the output zone 108. Lowering the completed print job by moving, removing, and/or opening the barrier can prevent damage to the completed print job. For example, previous systems can utilize a roller or belt to horizontally transfer the completed print job to an output area. However, the roller or belt 107 can potentially damage the completed print job due to distorted properties of the partially dried inkjet media as described herein. In some examples, the output zone 108 can be accessed by a user and the completed print job can be removed from an exterior position by a user.

In some examples, lowering the completed print job from the accumulation zone 106 to the output zone 108 can include releasing the partially dried inkjet media sheets from the number of clamps 105-1, 105-2, 105-3 and removing the barrier to utilize gravity to lower the completed print job to the output zone 108. In one example, a first portion of the number of clamps 105-1, 105-2, 105-3 can release a first side of the completed print job to allow the first side of the completed print job to be lowered to the output zone 108. In this example, a second portion of the number of clamps 105-1, 105-2, 105-3 can release a second side of the completed print job to allow the second side of the completed print job to be lowered to the output zone 108.

In some examples, the barrier can be a piecemeal barrier comprising a number of barrier portions that can be moved and/or removed to lower the completed print job from the accumulation zone 106 to the output zone 108. For example, the barrier can include a plurality of pieces that can each be moved or removed individually. In this example, each of the plurality of pieces can be moved or removed to lower the completed print job from the accumulation zone 106 to the output zone 108. In some examples, an elevator mechanism can be utilized to lower the completed print job from the accumulation zone 106 to the output zone 108 when the barrier is moved or removed. For example, the barrier can be removed and an elevator mechanism can be utilized to vertically lower the completed print job from the accumulation zone 106 to the output zone 108.

As described herein, the partially dried inkjet media finisher system 100 can minimize disruption and/or damage to a completed print job by providing a vertical transport from the accumulation zone 106 to the output zone 108 of the partially dried inkjet media finisher system 100.

Figure 2:
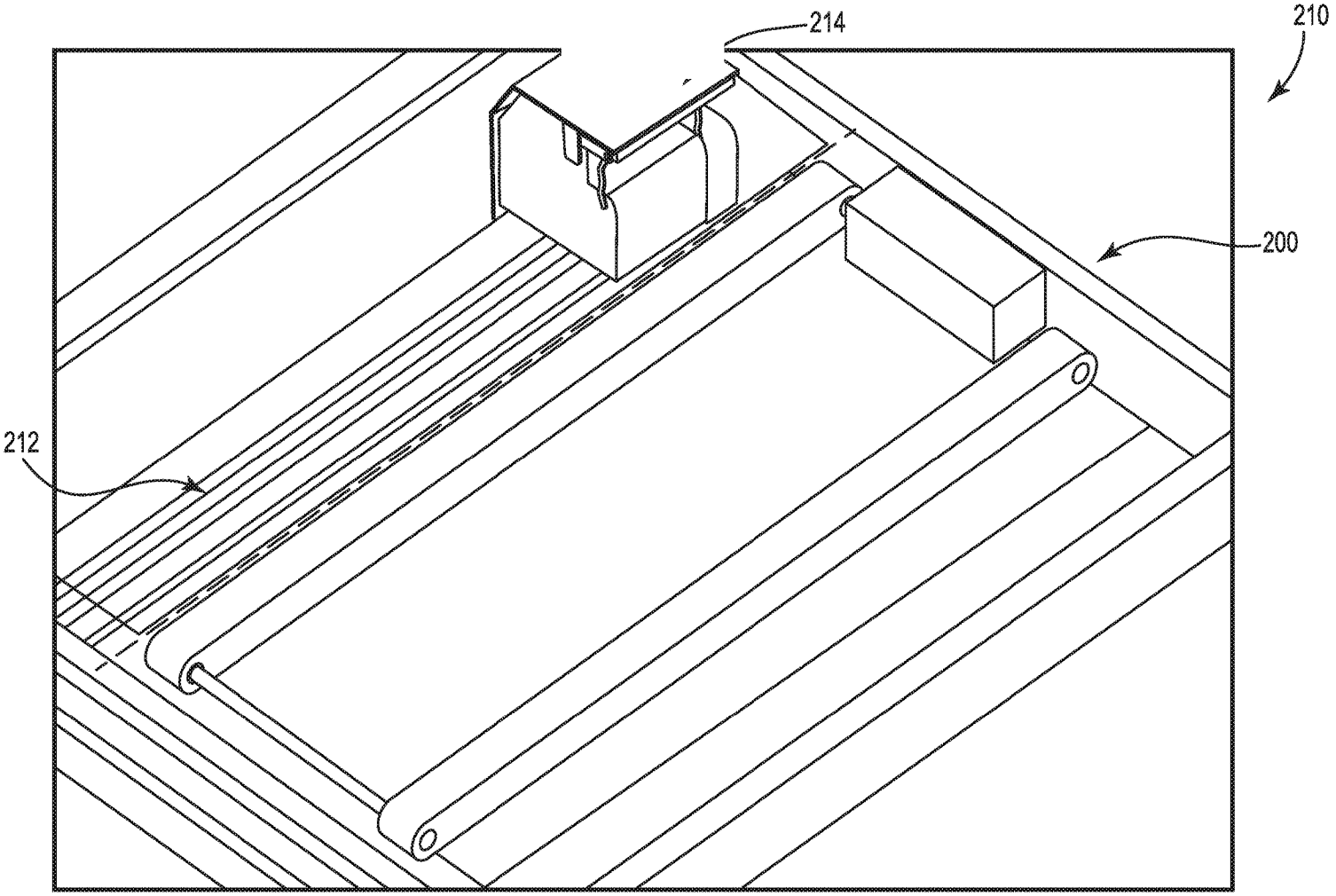
FIG. 2 illustrates an example system for a partially dried inkjet media finisher consistent with the present disclosure.

FIG. 2 illustrates an example system 210 for a partially dried inkjet media finisher consistent with the present disclosure. The system 210 can include a device to perform a finishing process area 212 coupled to a partially dried inkjet media finisher system 200. The partially dried inkjet media finisher system 200 can be the same or similar as the partially dried inkjet media finisher system 100 as referenced in FIG. 1. As described herein, the device to perform a finishing process area 212 can be coupled to the partially dried inkjet media finisher system 200 at a substantially horizontal position (e.g., behind the partially dried inkjet media finisher system 200, etc.).

As described herein, the device to perform a finishing process area 212 can be utilized to perform a number of different finishing processes (e.g., a stapling process, a hole punch process, an embossing process, a stitching process, etc.). In FIG. 2, a stapler 214 is shown in the device to perform a finishing process area 212, but the disclosure is not limited to this type of finishing process. In some examples, the stapler 214 can utilize a track to move the stapler 214 from a first corner of the partially dried inkjet media to a second corner of the partially dried inkjet media provided to the device to perform a finishing process area 212 from the partially dried inkjet media finisher system 200. As described herein, the partially dried inkjet media finisher system 200 can utilize a mezzanine (e.g., mezzanine 109 as referenced in FIG. 1) or similar device to move a stack of partially dried inkjet media into a portion of the device to perform a finishing process area 212 so the stapler 214 can access at least one edge of the stack of partially dried inkjet media. In some examples, the mezzanine or similar device can push the stack of partially dried inkjet media substantially horizontally to the device to perform a finishing process 212.

Having the device to perform a finishing process area 212 coupled along the edge of the partially dried inkjet media finisher system 200, the device to perform a finishing process area 212 can perform a number of finishing processes on multiple edges of the partially dried inkjet media. For example, the stapler 214 can move from a first corner of the partially dried inkjet media and staple a number of locations along an edge of the partially dried inkjet media.

Figure 3:
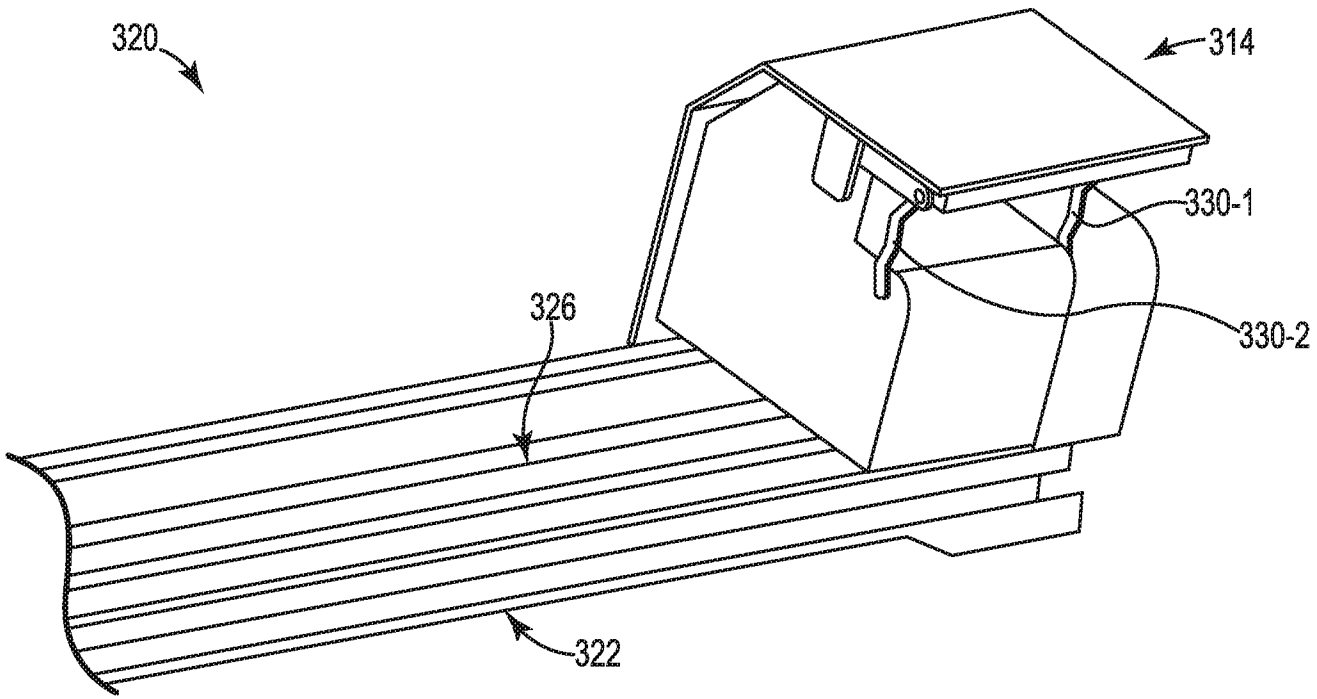
FIG. 3 illustrates an example system for a partially dried inkjet media finisher consistent with the present disclosure.

FIG. 3 illustrates an example system 320 for a partially dried inkjet media finisher consistent with the present disclosure. The system 320 can be one of a number of finishing processes that can be performed by a device to perform a finishing process (e.g., device to perform a finishing process area 212 as referenced in FIG. 2, etc.). In some examples, the system 320 can be utilized to provide a stapling finishing process on the partially dried inkjet media as described herein. The system 320 can be coupled to a partially dried inkjet media finisher system (e.g., partially dried inkjet media finisher system 200 as referenced in FIG. 2, etc.) in a substantially horizontal position with an accumulation zone (e.g., accumulation zone 106 as referenced in FIG. 1, etc.).

As described herein, the partially dried inkjet media can be moved to the system 320 via a mezzanine or similar device located within the accumulation zone or other area of the partially dried inkjet media finisher system. In some examples, the system 320 can include a stapler 314 that can be attached to a track 322 via a carriage. The track 322 can include a number of rack teeth 326 located in the track 322. In some examples, the stapler 314 can utilize the rack teeth 326 to move along the track 322 to position the stapler 314 at a particular position of the partially dried inkjet media.

In some examples, the stapler 314 can include a number of flags 330-1, 330-2. The number of flags 330-1, 330-2 can each be coupled to a number of sensors. In some examples, the stapler 314 can utilize a dual flag system to determine multiple locations along an edge of the partially dried inkjet media. For example, the first flag 330-1 can be utilized to determine an edge by a first corner of the partially dried inkjet media and the second flag 330-2 can be utilized to determine an edge by a second corner of the partially dried inkjet media. In some examples, the first flag 330-1 and the second flag 330-2 can be utilized to together to determine a number of additional locations along an edge of the partially dried inkjet media. For example, the first flag 330-1, and the second flag 330-2 can determine a plurality of locations along the edge of the partially dried inkjet media when a plurality of staples are requested along the edge of the partially dried inkjet media.

As used herein, "logic" is a processing resource to perform a particular action and/or function, etc., described herein, which includes hardware, e.g., various forms of transistor logic, application specific integrated circuits (ASICs), etc., as opposed to computer executable instructions, e.g., software firmware, etc., stored in memory and executable by a processor. Further, as used herein, "a" or "a number of" something can refer to one thing or a plurality of things. For example, "a number of widgets" can refer to one widget or a plurality of widgets.

The above specification, examples and data provide a description of the method and applications, and use of the system and method of the present disclosure. Since many examples can be made without departing from the spirit and scope of the system and method of the present disclosure, this specification merely sets forth some of the many possible example configurations and implementations.

What is claimed:

1. A device, comprising:

a media input zone to receive printed media, wherein the printed media is partially dried inkjet media;

a transport zone to receive the printed media from the media input zone to lower the print media to an accumulation zone that is coupled vertically below the transport zone, wherein the accumulation zone organizes the received printed media; and the accumulation zone to lower the printed media to an output zone coupled vertically below the accumulation zone, wherein the output zone receives a completed print job from the accumulation zone and wherein the transport zone, accumulation zone, and output zone are vertically stacked within the same footprint.

2. The device of claim 1, wherein the accumulation zone utilizes a mezzanine to lower the completed print job to the output zone.

3. The device of claim 1, wherein the accumulation zone organizes the received printed media by aligning, supporting, and holding the received printed media in a particular orientation.

4. The device of claim 1, wherein the media input zone extends along an edge of the accumulation zone, the transport zone, and the output zone.

5. The device of claim 1, wherein the accumulation zone utilizes a number of clamps to organize the received printed media.

6. A system, comprising:

a finisher coupled to an inkjet media printing device, the finisher comprising:

a media input zone to receive partially dried inkjet media from the printing device;

a transport zone coupled to the media input zone to receive the partially dried inkjet media from the media input zone, wherein the transport zone is located at a top portion of the finisher;

an accumulation zone coupled below the transport zone to receive the partially dried inkjet media from the transport zone; and an output zone coupled below the accumulation zone to receive the partially dried inkjet media from the accumulation zone upon completion of a print job wherein the transport zone, accumulation zone, and output zone are vertically stacked within the same footprint.

7. The system of claim 6, wherein the transport zone aligns the partially dried inkjet media for a finishing process.

8. The system of claim 7, wherein the finishing process includes at least one of a stapling process, a hole punch process, an embossing process, and a stitching process.

9. The system of claim 6, wherein the accumulation zone aligns the partially dried inkjet media for a finishing process.

10. The system of claim 6, wherein the finisher fits within a footprint of the printing device.

11. The system of claim 6, wherein the partially dried inkjet media includes media with deposited printing fluid from the printing device that is not completely dried.

12. A system for a partially dried inkjet media finisher, comprising:

a media input zone to transport partially dried inkjet media from a printing device to a transport zone located above the printing device, wherein the transport zone utilizes a number of clamps to align the received partially dried inkjet media;

an accumulation zone vertically below the transport zone to receive the partially dried inkjet media from the transport zone; and an output zone coupled vertically below the accumulation zone to receive the aligned partially dried inkjet media from the accumulation zone, wherein the transport zone, accumulation zone, and output zone are vertically stacked within the same footprint.

13. The system of claim 12, wherein the output zone receives the partially dried inkjet media from the accumulation zone after a finishing process.

14. The system of claim 13, wherein the accumulation zone and the output zone are separated by a barrier to eliminate interaction between the partially dried inkjet media within the accumulation zone and the partially dried inkjet media after the finishing process.

15. The system of claim 13, wherein the finishing process includes a process that utilizes a stapler rail to staple the aligned partially dried inkjet media at a plurality of locations of the partially dried inkjet media.

* * * * *